US006363590B1

(12) United States Patent
Lan

(10) Patent No.: US 6,363,590 B1
(45) Date of Patent: Apr. 2, 2002

(54) SAFETY BUCKLE WITH BUFFER MEANS

(75) Inventor: Chin-Kuo Lan, Ping-Chen (TW)

(73) Assignee: Taiwan Industrial Fastener Corporation, Taipei (TW)

( * ) Notice: Subject to any disclaimer, the term of this patent is extended or adjusted under 35 U.S.C. 154(b) by 0 days.

(21) Appl. No.: 09/535,537

(22) Filed: Mar. 27, 2000

(30) Foreign Application Priority Data

Dec. 16, 1999 (TW) ..... 88122080

(51) Int. Cl.[7] ..... A44B 11/26
(52) U.S. Cl. ..... 24/614; 24/627; 24/628
(58) Field of Search ..... 24/628, 614, 618, 24/625, 627, 68 R, 115 F, 68 J, 300, 301, 306, 442, 604, 615, 616, 602, 579.11

(56) References Cited

U.S. PATENT DOCUMENTS 4,226,589 A * 10/1980 Klein
4,742,605 A * 5/1988 Ritacco
5,444,899 A * 8/1995 Koppelomaki

FOREIGN PATENT DOCUMENTS

JP 9-173107 * 7/1997

* cited by examiner

*Primary Examiner*—James R. Brittain
(74) *Attorney, Agent, or Firm*—Bacon & Thomas

(57) ABSTRACT

A safety buckle includes a male buckle member and a female buckle member detachably fastened together, the female buckle member having a receiving chamber for receiving the male buckle member, wherein the female buckle member has a buffer element disposed in the front part thereof and defining a plurality of buffering spaces for buffering stretching force when the male buckle member and the female buckle member are pulled in reversed directions after locking.

11 Claims, 13 Drawing Sheets

SAFETY BUCKLE WITH BUFFER MEANS

BACKGROUND OF THE INVENTION

The present invention relates to buckles, and more particularly to a safety buckle, which has buffer means to buffer the force when the male buckle member and the female buckle member are pulled in reversed directions after locking.

A variety of buckles have been disclosed for use with sports bags, for example, golf bags, bowling ball bags, and etc. for enabling the bags to be fastened to an object, or the user's body. These buckles are commonly comprised of a male buckle member fastened to one strap member, and a female buckle member fastened to another strap member for receiving the male buckle member. These buckles have no means to buffer stretching force, and the parts may be damaged when heavily stretched.

FIGS. 13 and 14 show a buckle according to Taiwan Patent Publication No. 362394. This structure of buckle is comprised of a male buckle member A and a female buckle member B. The male buckle member A comprises a front hook A1, and a rear mounting slot A2 for the mounting of a strap member. The female buckle member B comprises a front receiving chamber B1 for receiving the male buckle member A, a button B3, and a hook B2 formed integral with the button B3 for engagement with the front hook A1 of the male buckle member A. After insertion of the male buckle member A into the receiving chamber B1 in the female buckle member B, the front hook A1 of the male buckle member A is hooked up with the hook B2 of the female buckle member B. When depressing the button B3, the hook B2 is disengaged from the front hook A1, enabling the male buckle member A to be disconnected from the female buckle member B. Because the hook B2 is formed integral with the button B3 and the female buckle member B has no means to buffer stretching force, the hooks B2 and A1 may be damaged when the male buckle member A and the female buckle member B are suddenly stretched.

SUMMARY OF THE INVENTION

The present invention provides a safety buckle, which eliminates the aforesaid problem. According to one aspect of the present invention, the safety buckle comprises a male buckle member, and a female buckle member having a receiving chamber for receiving the male buckle member, wherein the male buckle member comprises axially compressible buffer means that buffers stretching force when the male buckle member and the female buckle member are pulled in reversed directions after locking. According to another aspect of the present invention, the male buckle member comprises two side blocks formed integral with two opposite lateral side walls thereof, and the female buckle member comprises two longitudinal sliding grooves bilaterally disposed in the receiving chamber for receiving the side blocks of the male buckle member after insertion of the male buckle member into the receiving chamber in the female buckle member.

DETAILED DESCRIPTION OF THE PREFERRED EMBODIMENT

Figure 1:
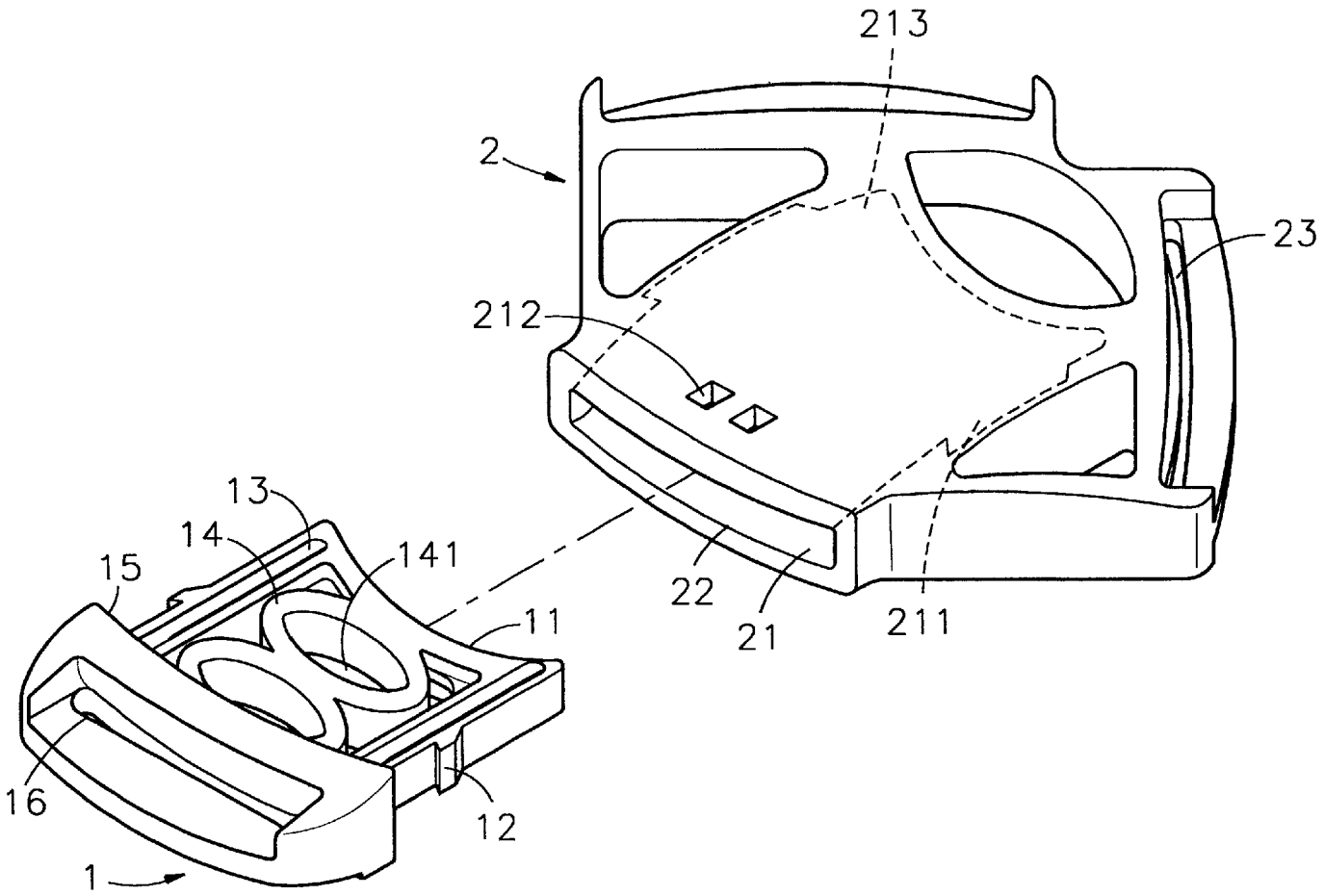
FIG. 1 is a perspective exploded view of a safety buckle according to one embodiment of the present invention.
Figure 1A:
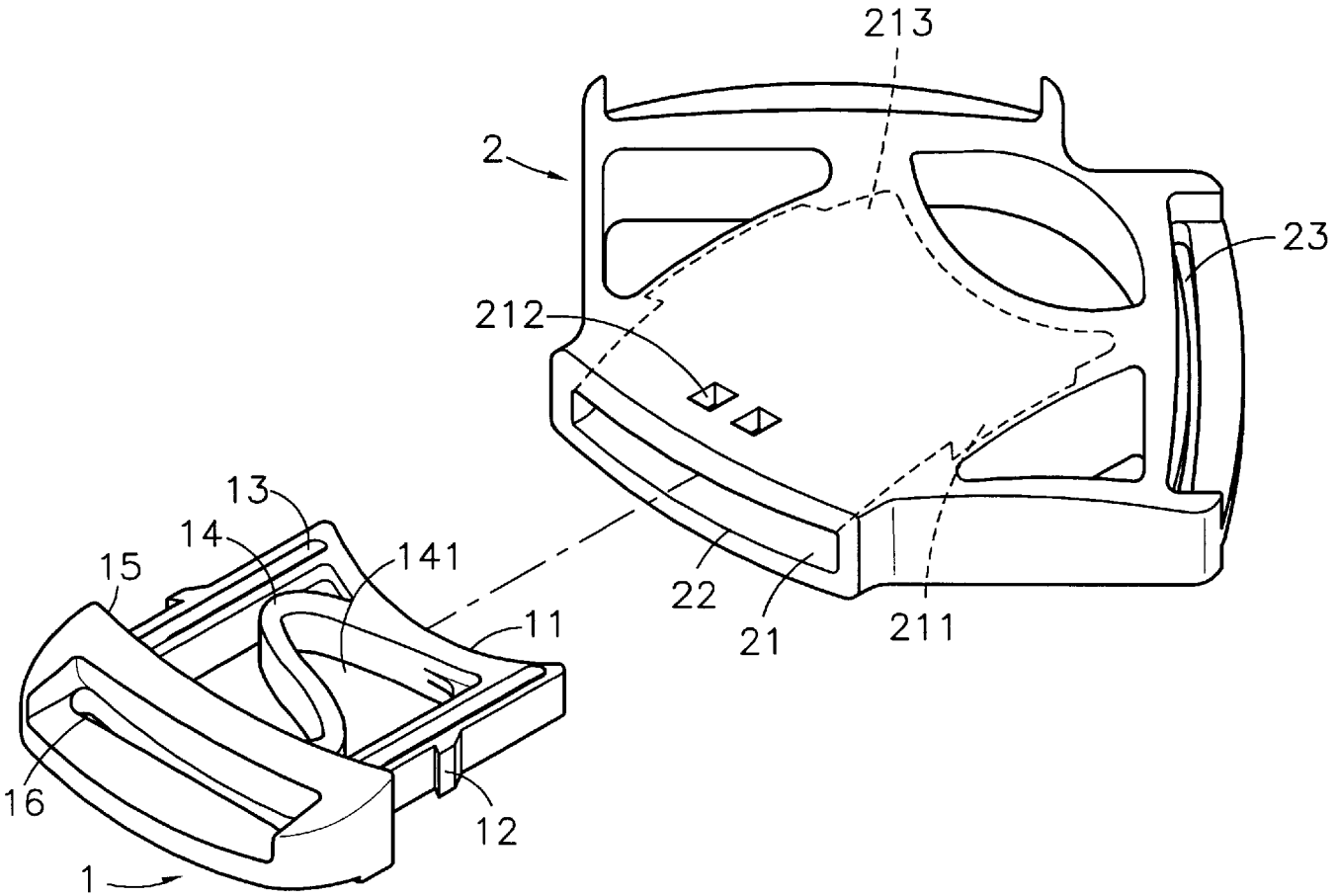
FIGS. 1A and 1B are perspective exploded views of safety buckles according to variations of the embodiment illustrated in FIG. 1.
Figure 1B:
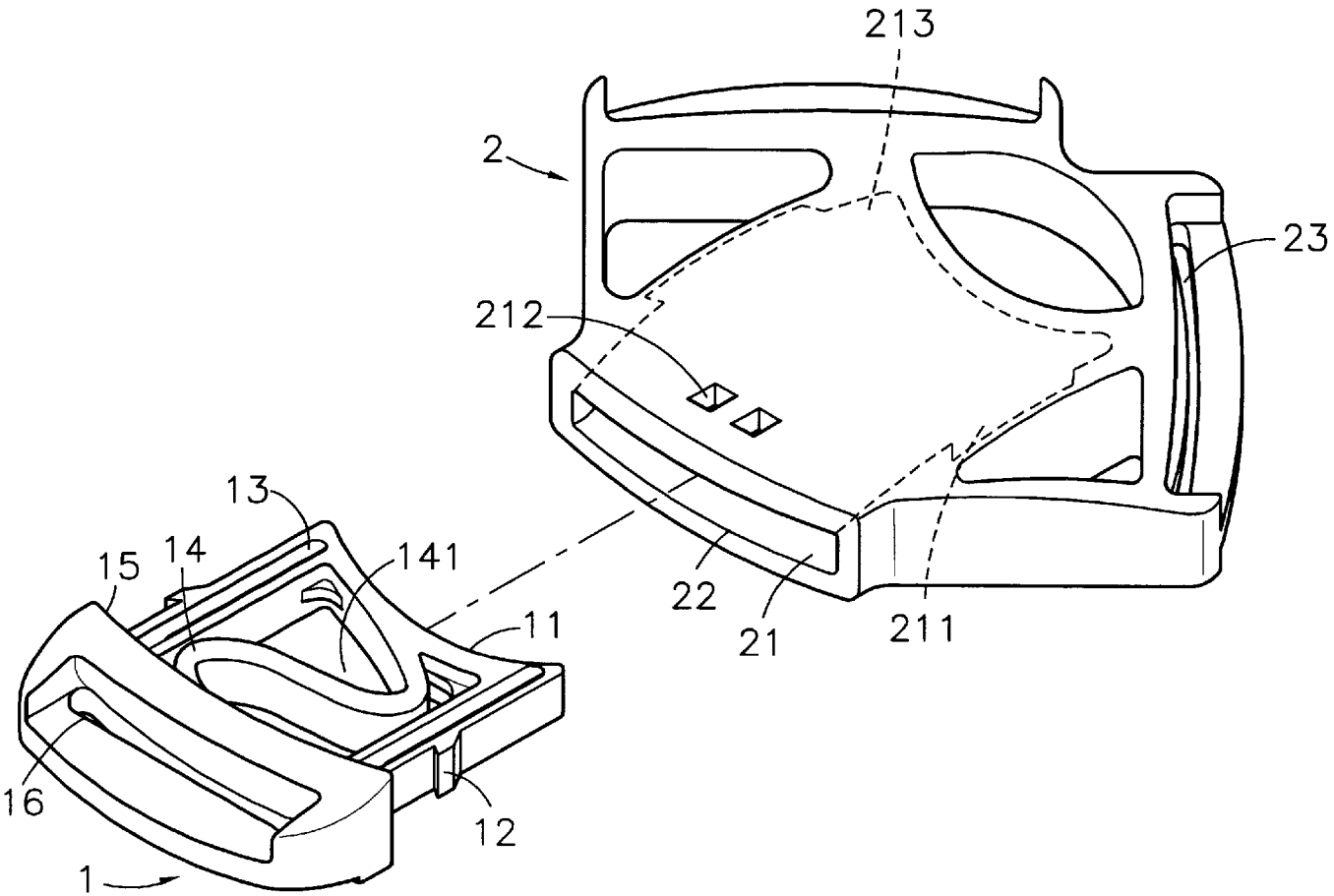
Figure 2:
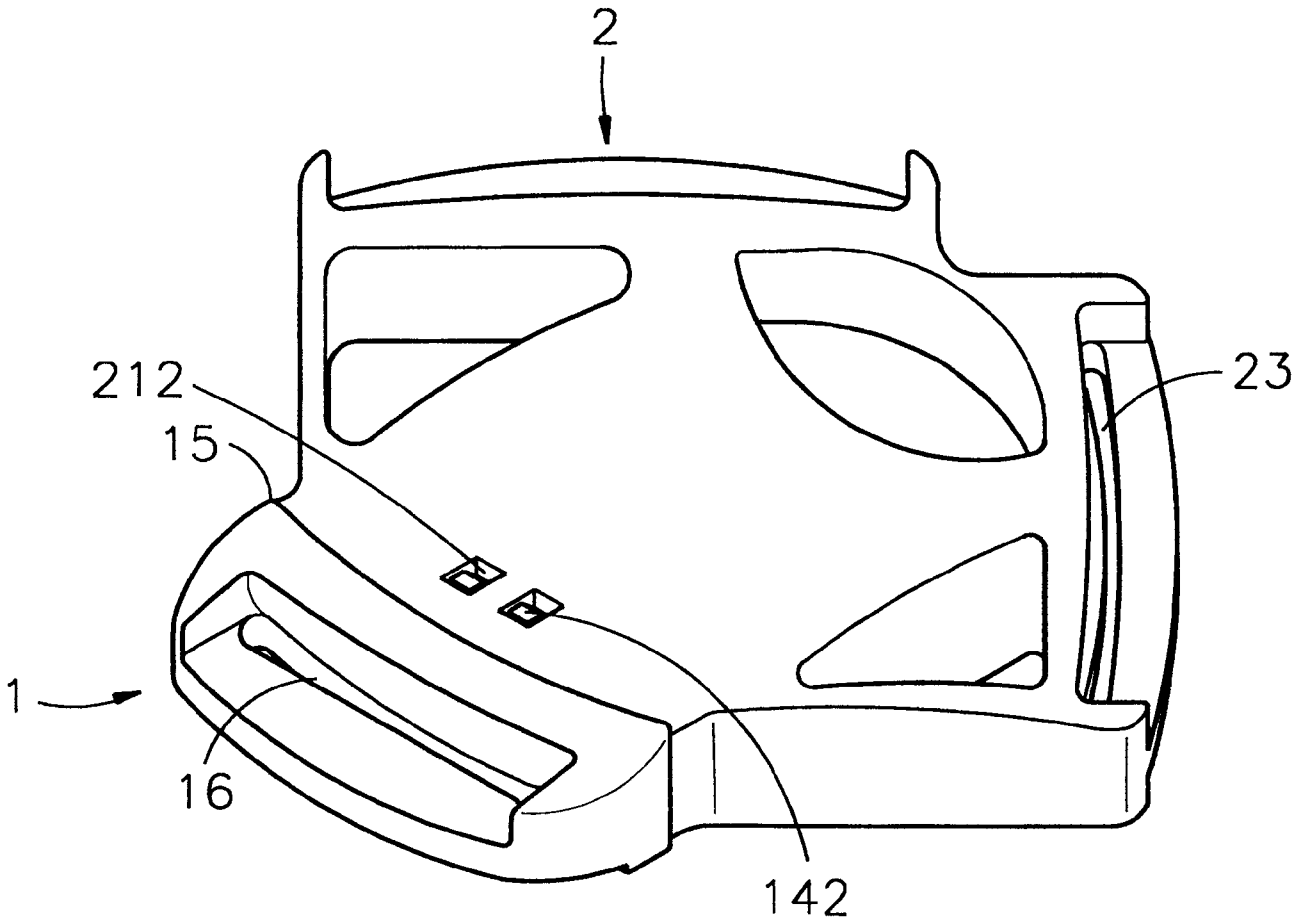
FIG. 2 is an elevational view of the present invention, showing the male buckle member and the female buckle member locked.
Figure 3:
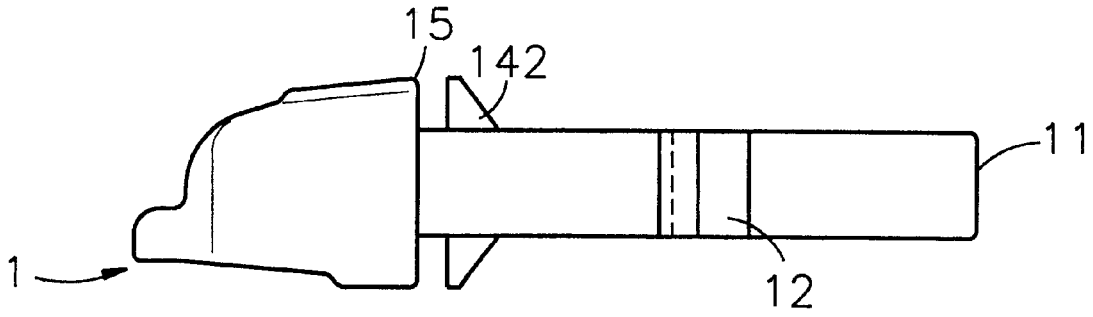
FIG. 3 is a side plain view of the male buckle member according to the present invention.
Figure 3A:
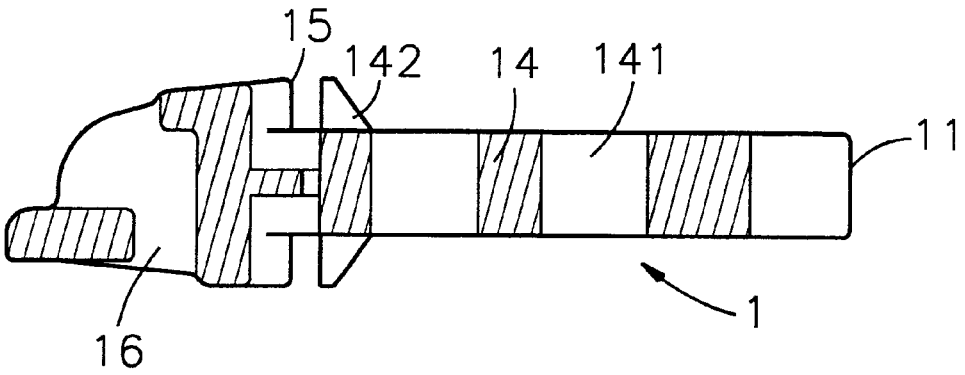
FIG. 3A is a side view in section of the male buckle member according to the present invention.
Figure 4:
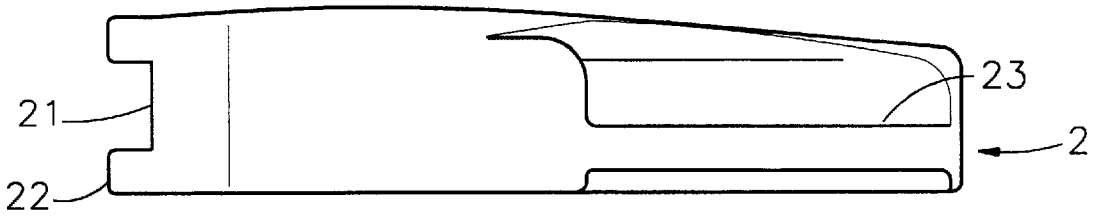
FIG. 4 is a side plain view of the female buckle member according to the invention.
Figure 4A:
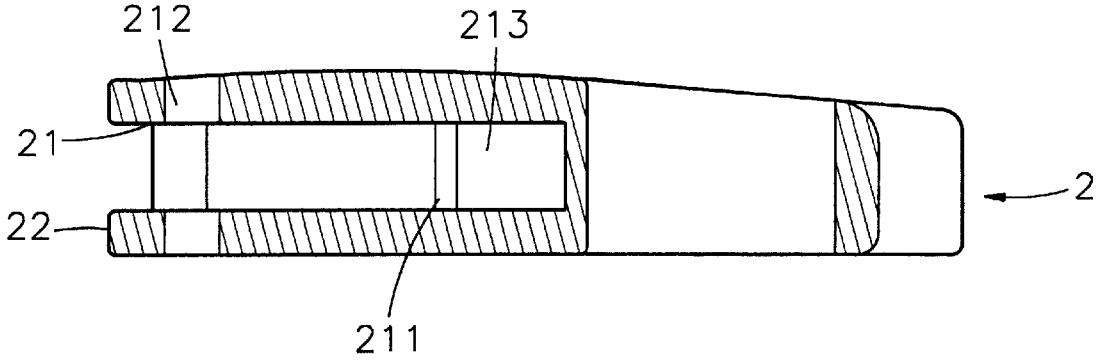
FIG. 4A is a side view in section of the female buckle member according to the present invention.
Figure 5:
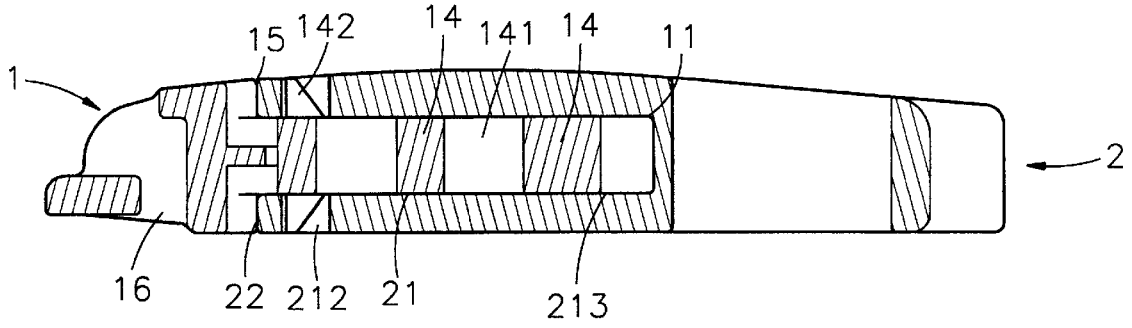
FIG. 5 is a side view in section of the present invention, showing the male buckle member and the female buckle member locked.

Referring to FIGS. 1, 1A, and 1B, a safety buckle in accordance with the present invention is generally comprised of a male buckle member 1, and a female buckle member 2. The male buckle member 1 comprises a buffer element 14 defining a plurality of buffering spaces 141. The buffer element 14 can be made having an 8-shaped profile, as illustrated in FIG. 1, or alternatively a Z-shaped profile, as illustrated in FIG. 1A, or an S-shaped profile as illustrated in FIG. 1B. After insertion of the male buckle member 1 into the receiving chamber 21 in the female buckle member 2, the male buckle member 1 and the female buckle member 2 are locked. If the buckle members 1 and 2 are suddenly stretched with the straps or belts connected thereto, the buffer element 14 is reciprocated in the receiving hole 21, and the buffering spaces 141 are compressed and released to buffer the stretching force.

Referring to FIGS. 1, 1A, 1B, 3 and 3A, the male buckle member 1 is shaped like a stepped plate (having a thinner front part and a thicker rear part), comprising a front side wall 11 curved inwards, two side blocks 12 respectively formed integral with two opposite lateral side walls thereof, two longitudinal slots 13 respectively disposed near the two opposite lateral side walls and arranged in parallel, a transverse mounting slot 16 near the rear side thereof for the mounting of a strap, belt, or the like, a substantially 8-shaped buffer element 14 disposed on the middle between the curved front side wall 11 and the transverse mounting slot 16 and defining a plurality of buffering spaces 141, a transverse stop edge 15 spaced between the buffer element 14 and the transverse mounting slot 16, and two hooked portions 142 formed integral with the buffer element 14 at a top side near the transverse stop edge 15.

Referring to FIGS. 1, 1A, 1B, 4 and 4A, the female buckle member 2 comprises a receiving chamber 21 for receiving the male buckle member 1, a vertical front stop edge 22 disposed around the receiving hole 21, two longitudinal sliding grooves 211 bilaterally disposed inside the receiving chamber 21, two hook holes 212 formed on the top side wall thereof in communication with the receiving chamber 21, and at least one, for example, two mounting slots 23 disposed outside the peripheral wall 213 of the receiving chamber 21 for the mounting of a respective strap, belt, or the like.

Referring to FIGS. 1, 1A, 1B, 5, 6, and 7, when inserting the curved front side wall 11 of the male buckle member 1 into the receiving chamber 21, the male buckle member 1 is compressed inwards by the peripheral wall 213 of the female buckle member 2, and the longitudinal slots 13 enable the front part of the male buckle member 2 to be compressed inwards. After insertion of the front part of the male buckle member 1 into the receiving chamber 21 in the female buckle member 2, the hooked portions 142 of the male buckle member 1 are forced into engagement with the hook holes 212 on the female buckle member 2, and the transverse stop edge 15 of the male buckle member 1 is stopped against the vertical front stop edge 22 of the female buckle member 2, and therefore the male buckle member 2 and the female buckle member 1 are firmly secured together.

Figure 6:
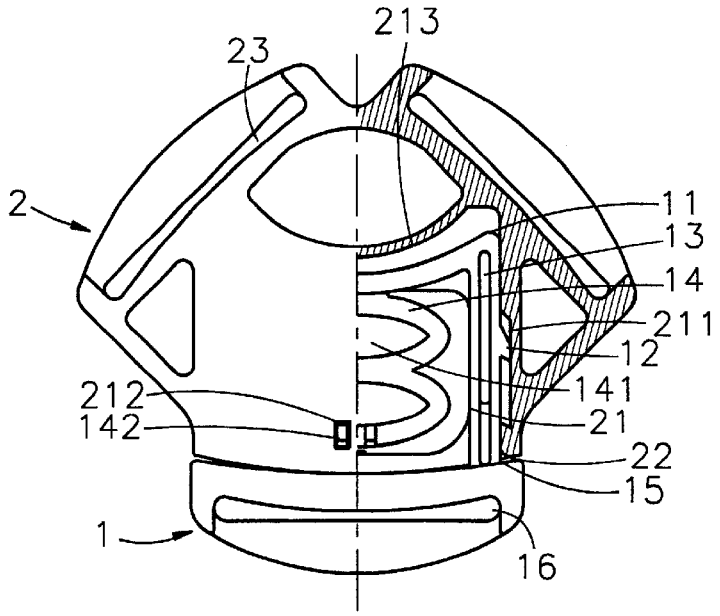
FIG. 6 is a top view with a part in section of the present invention, showing the male buckle member and the female buckle member locked.
Figure 7:
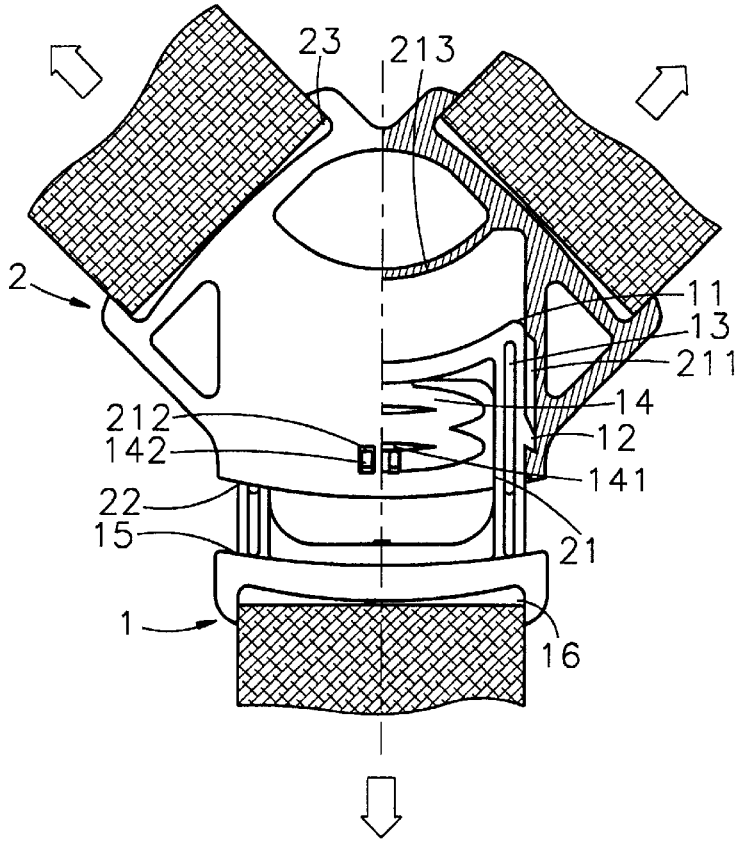
FIG. 7 is a schematic drawing, showing the male buckle member and the female buckle member pulled in reversed directions, the buffer element compressed.

Referring to FIGS. 6 and 7, when the strap (or belt) at the male buckle member 1 and the straps (or belts) are the female buckle member 2 are stretched, the male buckle member 1 and the female buckle member 2 are pulled in reversed directions, however, the hooked portions 142 are not moved relative to the female buckle member 2 because they are hooked up with the hook holes 212. At this time, the buffer element 14 is forced to deform and to buffer the stretching force, and the side blocks 12 are moved with the axially compressed front part of the male buckle member 1 in the receiving chamber 21 and stopped at one end of the longitudinal sliding groove 211.

Figure 8:
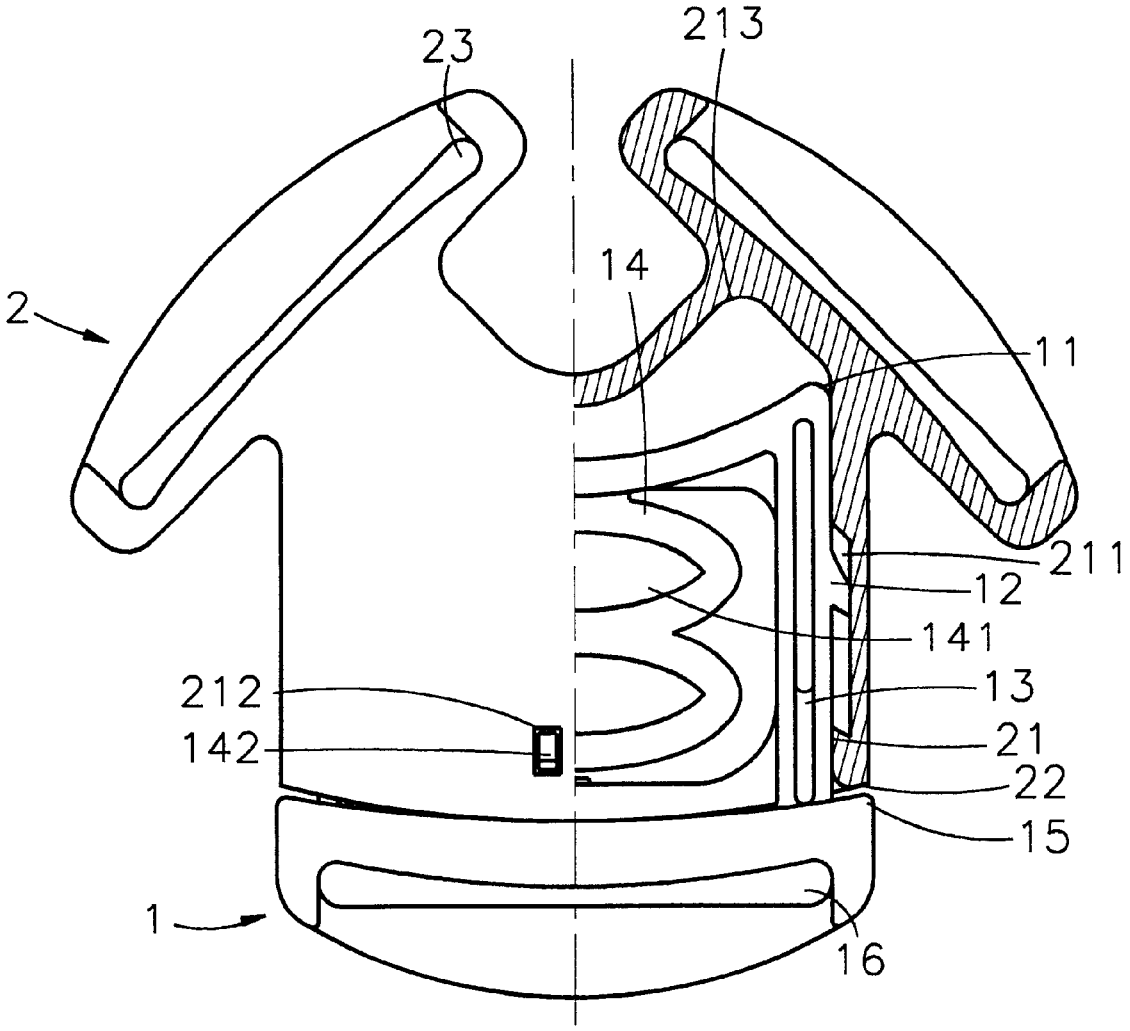
FIG. 8 is a top view with a part in section of an alternate form of the present invention.

FIG. 8 shows an alternate form of the present invention. According to this alternate form, the peripheral walls of the mounting slots 23 of the female buckle member 2 are separated from each other by an open space.

Figure 9:
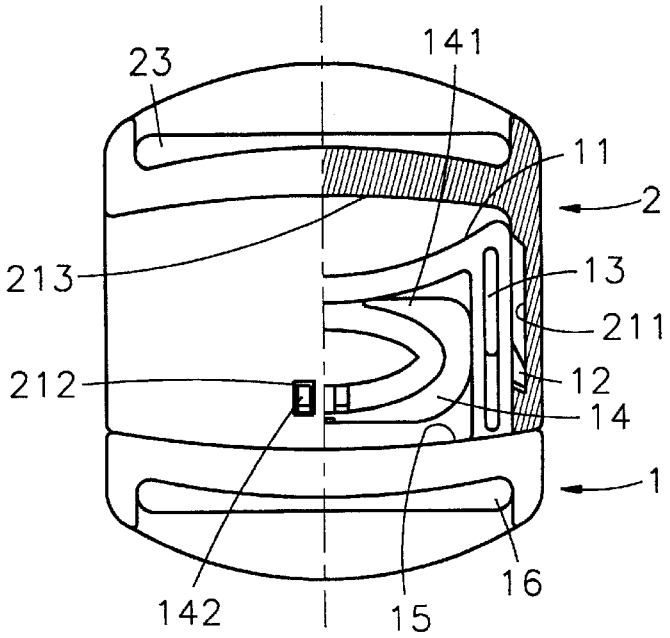
FIG. 9 is a top view with a part in section of another alternate form of the present invention.
Figure 10:
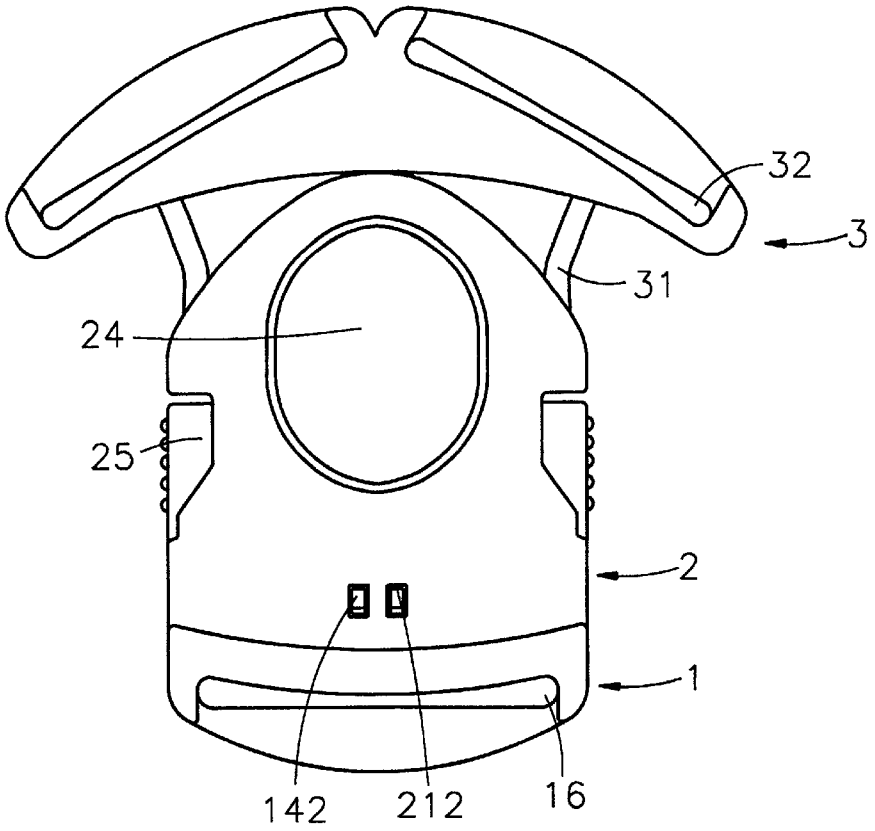
FIG. 10 is a top plain view of still another alternate form of the present invention.
Figure 11:
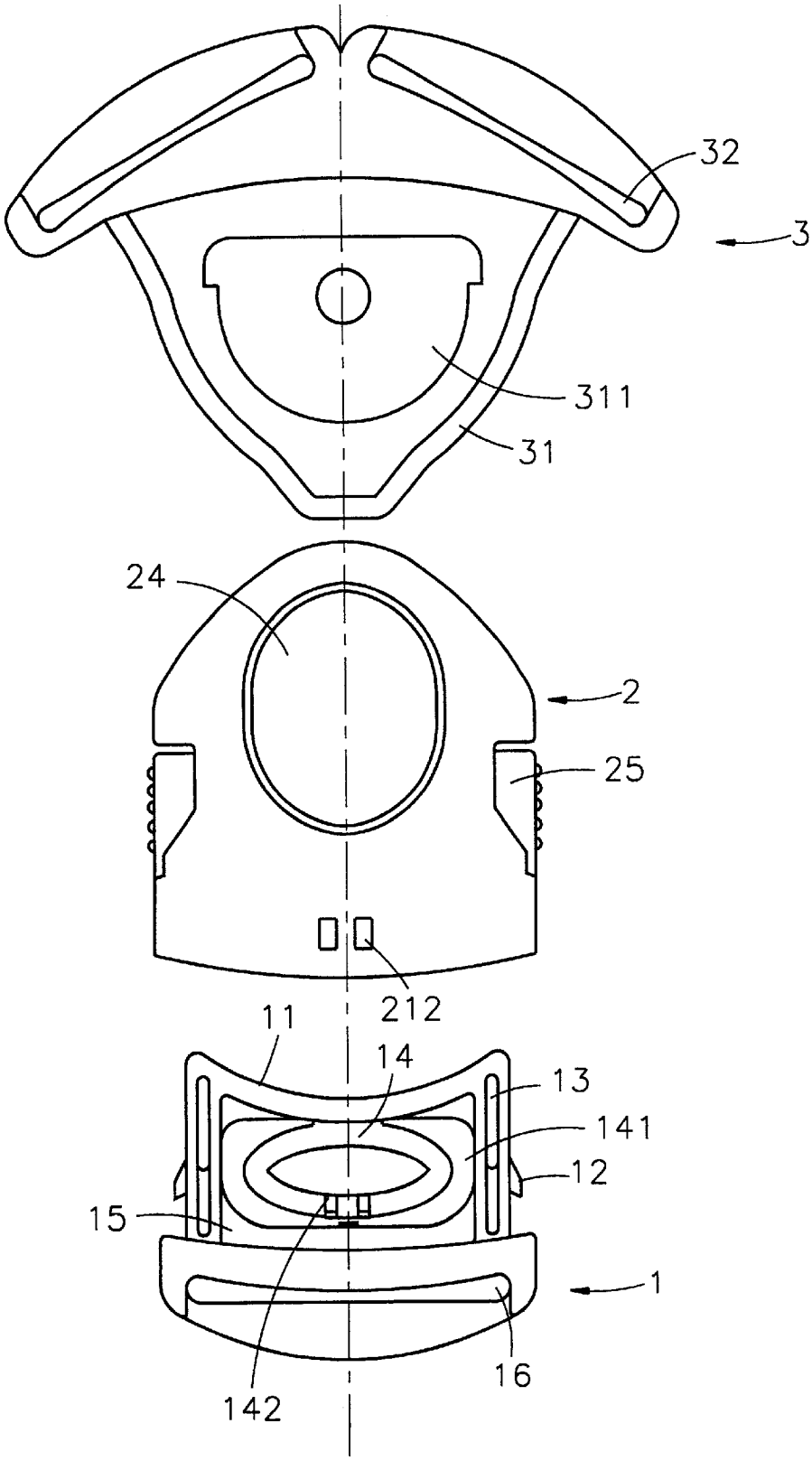
FIG. 11 is an exploded view of the embodiment shown in FIG. 10.
Figure 12:
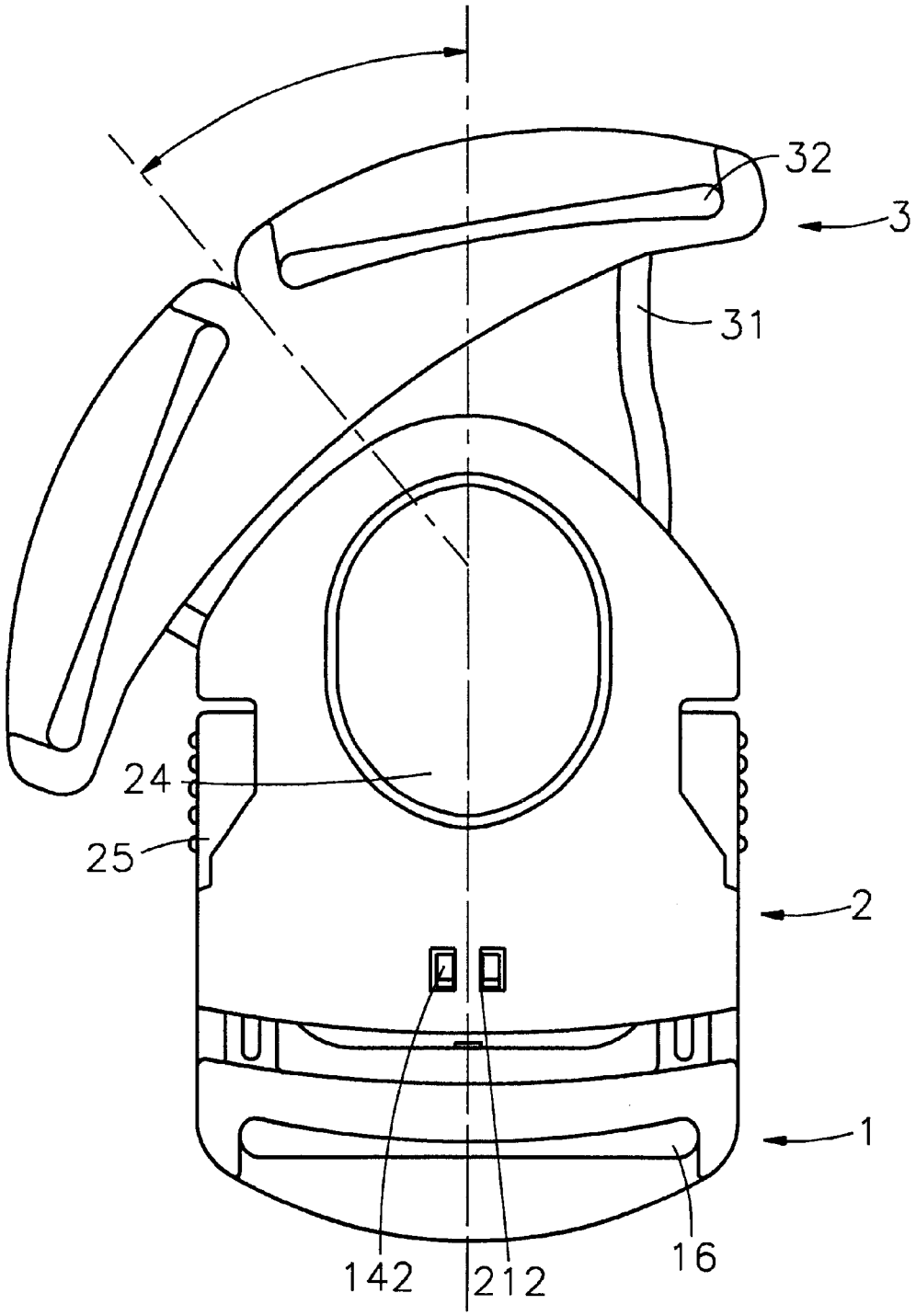
FIG. 12 is a schematic drawing showing the detachable mounting plate turned relative to the female buckle member according to the embodiment shown in FIGS. 10 and 11.
Figure 13:
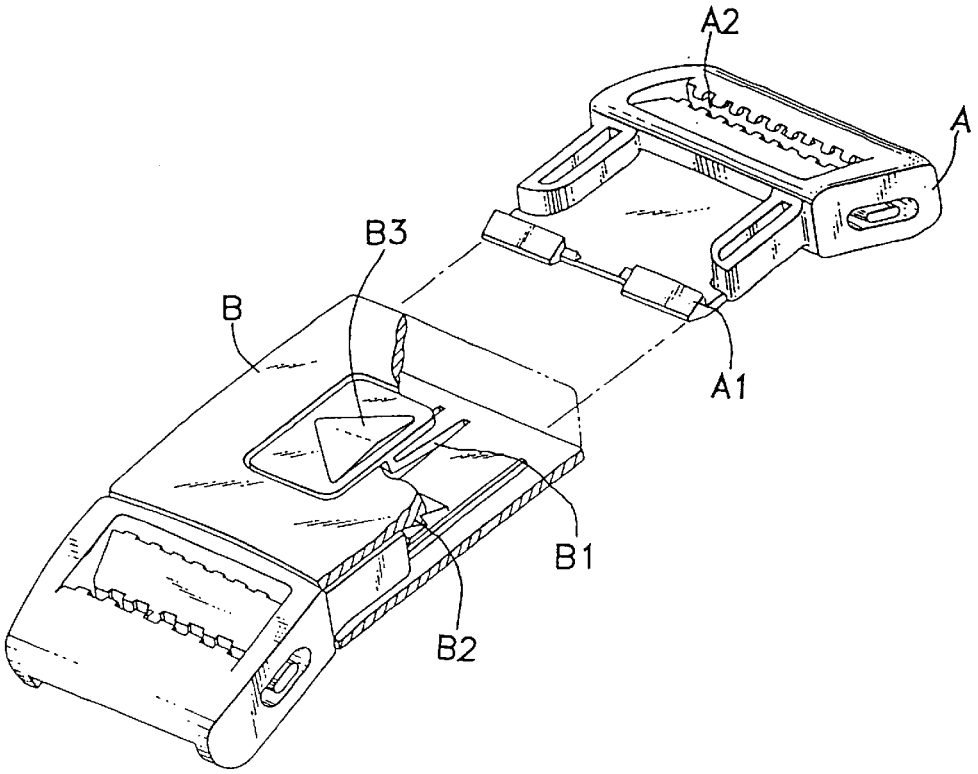
PRIOR ART FIG. 13
FIG. 13 is an exploded view of a buckle according to the prior art.
Figure 14:
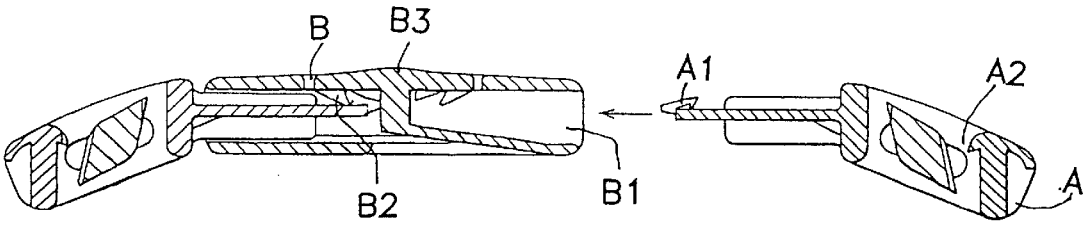
PRIOR ART FIG. 14
FIG. 14 is a side view in section of the buckle shown in FIG. 13.

FIG. 9 shows another alternate form of the present invention. According to this alternate form, the buffer element 14 has a loop-like profile.

FIGS. from 10 through 12 show still another alternate form of the present invention. According to this alternate form, the female buckle member 2 is made having a detachable mounting plate 3 secured thereto. The mounting plate 3 comprises a flat front insert 31, a positioning portion 311 formed integral with the front insert 31, and two mounting slots 32 for the mounting of a respective strap, belt, or the like. The female buckle member 2 is a hollow member, having a retainer spring 24 disposed on the inside for securing the positioning portion 311 upon insertion of the flat front insert 31 into the female buckle member 2, and two press knobs 25 for pressing by hand to release the retainer spring 24 from the positioning portion 311 of the rear part 3. After installation of the mounting plate 3, the positioning portion 311 is pivotally coupled to the retainer spring 24, enabling the mounting plate 3 to be turned relative to the female buckle member 2 within a limited angle.

It is to be understood that the drawings are designed for purposes of illustration only, and are not intended for use as a definition of the limits and scope of the invention disclosed.

What the invention claimed is:

1. A safety buckle comprising a male buckle member and a female buckle member detachably fastened together, said female buckle member comprising a receiving chamber for receiving said male buckle member, wherein said male buckle member comprises a buffer element disposed in a front part thereof and defining a plurality of buffering spaces for buffering a stretching force when said male buckle member and said female buckle member are pulled in reversed directions after locking, and wherein said male buckle member further comprises two side blocks respectively formed integral with two opposite lateral side walls of the front part thereof, and said female buckle member comprises two longitudinal sliding grooves bilaterally disposed inside said receiving chamber for receiving the side blocks of said male buckle member.

2. The safety buckle of claim 1 wherein said male buckle member comprises two longitudinal slots bilaterally spaced between said buffer element and said side blocks and arranged in parallel.

3. A safety buckle comprising a male buckle member and a female buckle member detachably fastened together, said female buckle member comprising a receiving chamber for receiving said male buckle member, wherein said male buckle member comprises a buffer element disposed in a front part thereof and defining a plurality of buffering spaces for buffering a stretching force when said male buckle member and said female buckle member are pulled in reversed directions after locking, and wherein said male buckle member further comprises two hooked portions formed integral with said buffer element, and said female buckle member comprises two hook holes formed on a top side wall thereof in communication with said receiving chamber for engagement with the hooked portions of said male buckle member.

4. The safety buckle of claim 1 wherein said female buckle member comprises a vertical front stop edge disposed around said receiving chamber, and said male buckle member comprises a transverse stop edge, which is stopped at the vertical front stop edge of said female buckle member after insertion of said male buckle member into the receiving chamber of said female buckle member.

5. The safety buckle of claim 1 wherein said male buckle member comprises at least one mounting slot disposed near a rear side thereof for the mounting of a respective strap member.

6. The safety buckle of claim 1 wherein said female buckle member comprises at least one mounting slot disposed outside said receiving chamber for the mounting of a respective strap member.

7. A safety buckle comprising a male buckle member and a female buckle member detachably fastened together, said female buckle member comprising a receiving chamber for receiving said male buckle member, wherein said male buckle member comprises a buffer element disposed in a front part thereof and defining a plurality of buffering spaces for buffering a stretching force when said male buckle member and said female buckle member are pulled in reversed directions after locking, and wherein said buffer element of said male buckle member has an 8-shaped profile.

8. The safety buckle of claim 1 wherein said buffer element of said male buckle member has a Z-shaped profile.

9. The safety buckle of claim 1 wherein said buffer element of said male buckle member has a S-shaped profile.

10. A safety buckle comprising a male buckle member and a female buckle member detachably fastened together, said female buckle member comprising a receiving chamber for receiving said male buckle member, wherein said male buckle member comprises a buffer element disposed in a front part thereof and defining a plurality of buffering spaces for buffering a stretching force when said male buckle member and said female buckle member are pulled in reversed directions after locking, and wherein said female buckle member is mounted with a detachable mounting plate having a flat insert and a positioning portion formed integral with said flat insert, comprising a retainer spring for securing said positioning portion for enabling said detachable mounting plate to be turned relative to said female buckle member within a limited angle after insertion of said flat insert into said female buckle member, and at least one press knob for operation by hand to release said retainer spring from the positioning portion of said detachable mounting plate.

11. The safety buckle of claim 10 wherein said detachable mounting plate comprises at least one mounting slot for the mounting of a respective strap member.

* * * * *